US010603702B2

(12) United States Patent
Nikaido et al.

(10) Patent No.: US 10,603,702 B2
(45) Date of Patent: Mar. 31, 2020

(54) METHOD FOR PRODUCING METAL SHEET WITH RAISED LINES, METAL SHEET WITH RAISED LINES, AND STRUCTURAL COMPONENT

(71) Applicant: NIPPON STEEL & SUMITOMO METAL CORPORATION, Tokyo (JP)

(72) Inventors: Hitoshi Nikaido, Kisarazu (JP); Toru Yonebayashi, Tokai (JP); Koichi Sato, Tokai (JP); Teruo Ito, Himeji (JP); Daiki Kamada, Himeji (JP)

(73) Assignee: NIPPON STEEL CORPORATION, Tokyo (JP)

( * ) Notice: Subject to any disclaimer, the term of this patent is extended or adjusted under 35 U.S.C. 154(b) by 310 days.

(21) Appl. No.: 15/512,848

(22) PCT Filed: Oct. 7, 2015

(86) PCT No.: PCT/JP2015/005092

§ 371 (c)(1),
(2) Date: Mar. 21, 2017

(87) PCT Pub. No.: WO2016/056234

PCT Pub. Date: Apr. 14, 2016

(65) Prior Publication Data

US 2017/0320113 A1 Nov. 9, 2017

(30) Foreign Application Priority Data

Oct. 9, 2014 (JP) ..... 2014-208072
Oct. 9, 2014 (JP) ..... 2014-208073
Mar. 16, 2015 (JP) ..... 2015-051992

(51) Int. Cl.
*B21B 1/08* (2006.01)
*B21D 53/88* (2006.01)
(Continued)

(52) U.S. Cl.
CPC ..... *B21B 1/0805* (2013.01); *B21B 1/08* (2013.01); *B21B 27/02* (2013.01); *B21B 27/021* (2013.01);
(Continued)

(58) Field of Classification Search
CPC .. B21B 1/24; B21B 1/092; B21B 1/12; B21B 1/222; B21B 35/02; B21B 1/08;
(Continued)

(56) References Cited

U.S. PATENT DOCUMENTS 4,433,565 A * 2/1984 Preller ..... B21B 1/08 72/177
9,364,878 B2 * 6/2016 Ritter ..... B21B 37/58
2010/0218576 A1 * 9/2010 Felkl ..... B21B 37/46 72/6.2

FOREIGN PATENT DOCUMENTS

CN 102179697 12/2012
DE 10 2011 078150 12/2012
(Continued)

OTHER PUBLICATIONS

Sakata, Translation of JP-2005324206-A (Year: 2005).*
(Continued)

*Primary Examiner* — Adam J Eiseman
*Assistant Examiner* — Bobby Yeonjin Kim
(74) *Attorney, Agent, or Firm* — Clark & Brody

(57) ABSTRACT

A method for producing a metal sheet with raised lines uses a rolling mill including roll stands. In a preparing step, a grooved roll is prepared, the grooved roll including grooves. In a choosing step, a stand at least one stage before the last stand is chosen. In an incorporating step, the grooved roll is incorporated in as an upper roll of the chosen, specified stand. In a forming step, a workpiece is formed into a metal sheet with raised lines formed corresponding to the respec-
(Continued)

tive grooves. In the forming step, a maximum rolling reduction achieved by rolls of the specified stand is set to a provisional value that is lower than a required value. After the leading edge of the workpiece reaches the stand next to the specified stand, the maximum rolling reduction of the specified stand is changed to the required value.

7 Claims, 7 Drawing Sheets

(51) Int. Cl.
*B21H 8/00* (2006.01)
*B21B 27/02* (2006.01)
*B21H 8/02* (2006.01)

(52) U.S. Cl.
CPC ..... *B21D 53/88* (2013.01); *B21H 8/00* (2013.01); *B21H 8/02* (2013.01)

(58) Field of Classification Search
CPC . B21B 37/72; B21B 2273/06; B21B 2273/12; B21B 2273/14; B21B 2265/12
USPC ..... 72/226, 234
See application file for complete search history.

(56) References Cited

FOREIGN PATENT DOCUMENTS

| | | | | | |
|---|---|---|---|---|---|
| JP | 58-159901 | | | 9/1983 | |
| JP | 60-49801 | | | 3/1985 | |
| JP | 61-119319 | | | 6/1986 | |
| JP | 63-104703 | | | 5/1988 | |
| JP | 1-262003 | | | 10/1989 | |
| JP | 01262003 | A | * | 10/1989 | ..... B21B 1/08 |
| JP | 07-204719 | | | 8/1995 | |
| JP | 08-174129 | | | 7/1996 | |
| JP | 8-197106 | | | 8/1996 | |
| JP | 2005-324206 | | | 11/2005 | |
| JP | 2005324206 | A | * | 11/2005 | ..... B21B 1/08 |
| JP | 2012-131316 | | | 7/2012 | |
| JP | 2013-189173 | | | 9/2013 | |
| JP | 2014-091462 | | | 5/2014 | |

OTHER PUBLICATIONS

Kusaba, Translation of JP 01262003-A (Year: 1989).*
Oh, Gyeong Sik, "Soft Reduction Technology for Steel in Continuous Casting" The Korean Institute of Metals and Materials, Academic Discussion on Metal Smelting, 1994, vol. 7, p. 71-106.

* cited by examiner

METHOD FOR PRODUCING METAL SHEET WITH RAISED LINES, METAL SHEET WITH RAISED LINES, AND STRUCTURAL COMPONENT

TECHNICAL FIELD

The present invention relates to a metal sheet such as a steel sheet suited to be used in structural components of automobiles, various kinds of vehicles other than automobiles, home appliances, vessels, construction materials and so on. In particular, the present invention relates to a metal sheet with raised lines, on one of the upper surface and the lower surface, one or more raised lines extending in the rolling direction, a method for producing the metal sheet with raised lines, and a structural component produced by use of the metal sheet with raised lines.

BACKGROUND ART

Pressed parts are used in general structural components. The material of a pressed part is a metal sheet such as a steel sheet. A structural component is formed from a single pressed part or formed by joining a plurality of pressed parts. For example, the structural components for automobiles described in Japanese Patent Application Publication No. 2013-189173 (Patent Literature 1) and Japanese Patent Application Publication No. 2014-91462 (Patent Literature 2) each include a vertically-long pressed part. The cross section of the pressed part is U-shaped.

FIGS. 1A and 1B show an example of a structural component. Of these drawings, FIG. 1A is a perspective view of the structural component, and FIG. 1B is a cross-sectional view of an end portion of the structural component illustrated in FIG. 1A. The structural component 20 illustrated in FIGS. 1A and 1B includes two pressed parts 21, each having a U-shaped cross section. Each of the pressed parts 21 includes a plate portion 24 and flanges 22 extending from the both sides of the plate portion 24. By welding the flanges 22 of the two pressed parts 21 together, the structural component 20 in the shape of a square-pipe is obtained. Reinforcing plates 40 are welded to the back side of the two plate portion 24 and four ridge portions 23 of the structural component 20, at both end portions in the longitudinal direction. In this case, however, the strength of the structural component 20 is increased only at both end portions in the longitudinal direction. Therefore, it can be considered that the reinforcement of the structural component 20 is not sufficient.

In order to produce a partly-reinforced structural component such as the structural component 20 illustrated in FIGS. 1A and 1B, it is necessary to weld the reinforcing plates 40 to the portions that need to be reinforced. Accordingly, a welding process must be separately carried out to partly reinforce the structural component 20, which results in an increase in manufacturing cost.

CITATION LIST

Patent Literature

Patent Literature 1: Japanese Patent Application Publication No. 2013-189173

Patent Literature 2: Japanese Patent Application Publication No. 2014-91462

SUMMARY OF INVENTION

Technical Problem

The present invention has been made in view of the above circumstances. An object of the present invention is to provide a production method that, in producing a partly-reinforced structural component, facilitates the production of a metal sheet with raised lines suitable as a material for the structural component. In addition, another object of the present invention is to provide a metal sheet with raised lines suited to be used for the production of the structural component, and a structural component using the metal sheet with raised lines.

Solution to Problem (1) A metal sheet production method according to an embodiment of the present invention is a method for producing a metal sheet by use of a rolling mill including at least two roll stands, the metal sheet including, on an upper surface or a lower surface, one or more raised lines extending in a rolling direction. The production method includes a preparing step, a choosing step, an incorporating step, and a forming step. In the preparing step, a grooved roll is prepared, the grooved roll including, in an outer peripheral surface, one or more grooves extending in a circumferential direction. In the choosing step, a roll stand at least one stage before a last roll stand is chosen from the roll stands.

In the incorporating step, the grooved roll is incorporated in the rolling mill as an upper roll or a lower roll of the chosen, specified roll stand. In the forming step, a workpiece is rolled by the rolling mill incorporating the grooved roll, thereby forming the workpiece into a metal sheet with raised lines formed corresponding to the respective grooves of the grooved roll. At this point, in the forming step, until a leading edge of the workpiece reaches a roll stand next to the specified roll stand, a maximum rolling reduction achieved by rolls of the specified roll stand is set to a provisional value that is lower than a required value. Then, after the leading edge of the workpiece reaches the roll stand next to the specified roll stand, the maximum rolling reduction achieved by the rolls of the specified roll stand is changed to the required value.

In the production method (1), the required value is preferably 10 to 80%.

In the production method (1), the provisional value is preferably 10 to 90% of the required value.

In the production method (1), it is preferred that, in a longitudinal section of the grooved roll, the grooves are in a bilaterally symmetric arrangement.

In the production method (1), in a longitudinal section of the grooved roll, the grooves may be rectangular, trapezoidal or V-shaped.

In the production method (1), each of the grooves of the grooved roll may have a width more than 5 mm and less than 2000 mm.

In the production method (1), the grooves of the grooved roll may be at a pitch more than 15 mm and less than 2000 mm.

(2) A metal sheet with raised lines according to an embodiment of the present invention is a metal sheet including one or more raised lines on an upper surface or a lower surface. The raised lines are at a pitch more than 15 mm and less than 2000 mm. A sheet thickness ratio (t/tmin) of a raised-line sheet thickness t to a minimum sheet thickness tmin is more than 1.0 and less than 10.0, the raised-line sheet thickness t being expressed as a sum of the minimum sheet thickness tmin and a height h of the raised lines.

In the metal sheet with raised lines (2), each of the raised lines may have a width more than 5 mm and less than 2000 mm.

(3) A structural component according to an embodiment of the present invention including one or more raised lines on a front side or a back side. The structural component includes a reinforced portion that is increased in strength, and the raised lines are disposed on the front side or the back side of the reinforced portion.

Advantageous Effects of Invention

The production method according to the present invention facilitates the production of a metal sheet with raised lines. This metal sheet with raised lines includes, on one of an upper surface and a lower surface, one or more raised lines extending in a rolling direction. Accordingly, using the metal sheet with raised lines as a material to produce a partly-reinforced structural component allows for production of a structural component including a reinforced portion that is reinforced in the entire area. Thus, the metal sheet with raised lines according to the present invention is suitable as a material for a partly-reinforced structural component.

DESCRIPTION OF EMBODIMENTS

Some embodiments of the present invention will hereinafter be described with reference to the drawings.

[Producing Metal Sheet with Raised Lines]

Figure 2:
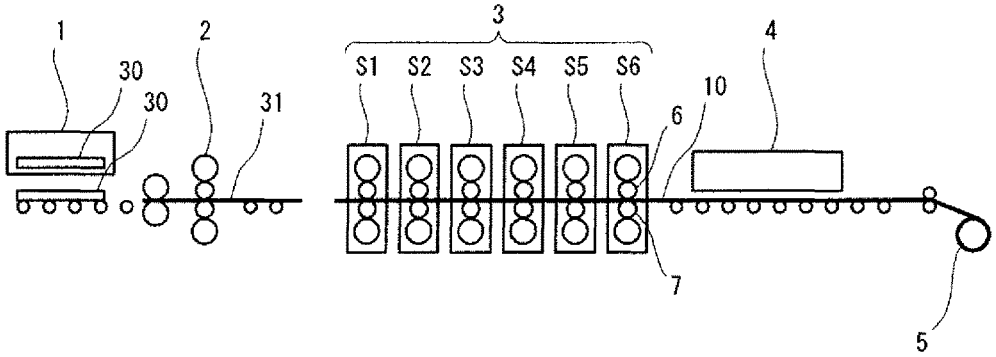
FIG. 2 is a schematic diagram of an example of a production facility used for the production of a metal sheet with raised lines according to an embodiment of the present invention.

FIG. 2 is a schematic diagram of an example of a production facility used for the production of a metal sheet with raised lines according to an embodiment of the present invention. The present embodiment describes the production of a steel sheet 10 with raised lines as an example of the production of a metal sheet with raised lines. Specifically, in the following, the production of a metal sheet with raised lines with a steel slab 30 used as a material for the metal sheet with raised lines will be described.

The production facility illustrated in FIG. 2 includes a heating furnace 1, a rough-rolling mill 2, a finish-rolling mill 3, a cooling device 4, and a coiler 5 that are arranged in this order. The heating furnace 1 heats the slab 30. The heated slab 30 is first fed to the rough-rolling mill 2. The rough-rolling mill 2 rolls the slab 30 to form the slab 30 into a longer-length steel plate 31 having a thickness of, for example, about 50 mm. The steel plate 31 is fed to the finish-rolling mill 3. The finish-rolling mill 3 includes a row of six roll stands S1 to S6 (which may hereinafter be referred to as simply "stands"). The steel plate 31 is rolled while passing through the stands S1 to S6 successively, whereby the steel plate 31 is formed into a steel sheet 10 having a desired thickness. Thus, the steel plate 31 is a workpiece to be rolled by the finish-rolling mill 3. The steel sheet 10 is cooled while passing through the cooling device 4, and is wound up into a coil by the caller 5.

Each of the stands S1 to S6 of the finish-rolling mill 3 includes an upper roll 6 and a lower roll 7 (work rolls), and further includes back-up rolls paired with the rolls 6 and 7 respectively. Each of the stands S1 to S6 is provided with an inter-roll-axis distance adjustment mechanism (not shown in the drawings). Each inter-roll-axis distance adjustment mechanism adjusts the distance between the axis of the upper roll 6 and the axis of the lower roll 7. The inter-roll-axis distance adjustment mechanism allows for adjustment of the rolling reduction achieved by the upper roll 6 and the lower roll 7 in each of the stands S1 to S6.

Each of the stands S1 to S6 is provided with a load cell (not shown in the drawings). The load cell measures the rolling load applied by the upper roll 6 and the lower roll 7. The load cell allows for monitoring of the rolling load in each of the stands S1 to S6. The load cell also allows for detection of a time point at which the leading edge of the steel plate 31 reaches each of the stands S1 to S6 (a time point at which the leading edge of the steel plate 31 is pinched in a gap between the upper roll 6 and a lower roll 7).

However, in a case where any of the stands S1 to S6 does not perform to roll the steel plate 31, no rolling load occurs in the non-rolling-performing stand. In this case, detection as to whether the leading edge of the steel plate 31 has reached the non-rolling-performing stand can be carried out by use of the output from the load cell provided in a rolling-performing stand that is one stage before the non-rolling-performing stand. Specifically, the load cell detects the leading edge of the steel plate 31 reaching the rolling-performing stand, and an elapsed time from a time point of the detection is measured. Based on the elapsed time, a theoretical running speed of the workpiece due to rolling by the rolling-performing stand, and a distance between a roll axis of the rolling-performing stand and a roll axis of the next non-rolling-performing stand, it is possible to calculate the time point at which the leading edge of the steel plate 31 has reached the non-rolling-performing stand. However, each of the stands S1 to S6 may be provided with a sensor that detects passing of the leading edge of the steel plate 31.

In the present embodiment, in order to produce the steel sheet 10 with raised lines, a grooved roll, which will be described later, is incorporated in one specified roll stand that is selected from among the roll stands S1 to S6 of the finish-rolling mill 3. The specified stand is chosen according to rolling capabilities (e.g., rolling loads, rolling reductions, etc.) of the stands S1 to S6. For example, in the finish-rolling mill 3 illustrated in FIG. 2, the fourth stand S4, which is two stages before the last sixth stand S6, incorporates the grooved roll. There is no particular limit to the stand to incorporate the grooved roll. It is noted that the grooved roll should not be incorporated in the last stand S6 in the present embodiment because of a reason to be described later. In other words, the grooved roll is incorporated in a stand at least one stage before the last stand S6. One or more stands in stages subsequent to the stand including the grooved roll incorporated therein each serve as a non-rolling-performing stand, which does not substantially roll, and rolls incorporated in the non-rolling-performing stand function as rolls for conveyance.

Figure 3:
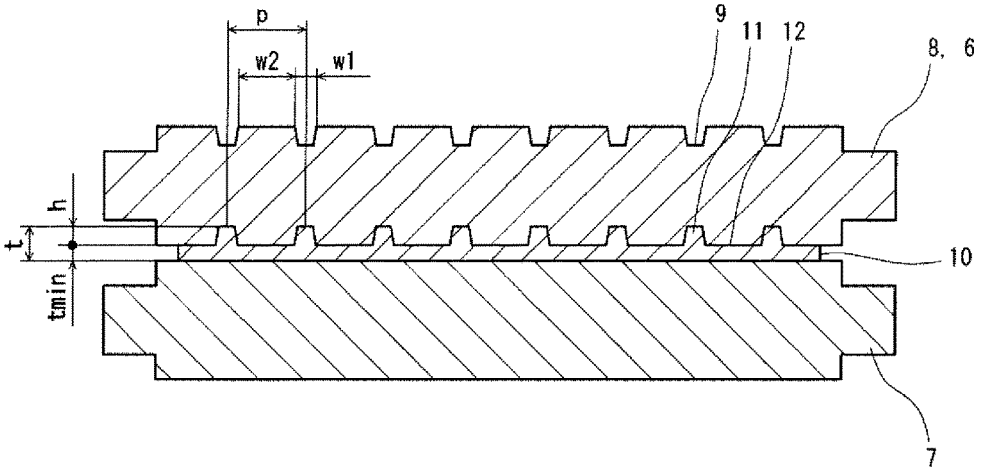
FIG. 3 is a cross-sectional view of an example of a roll stand incorporating a grooved roll according to the embodiment of the present invention.
Figure 4:
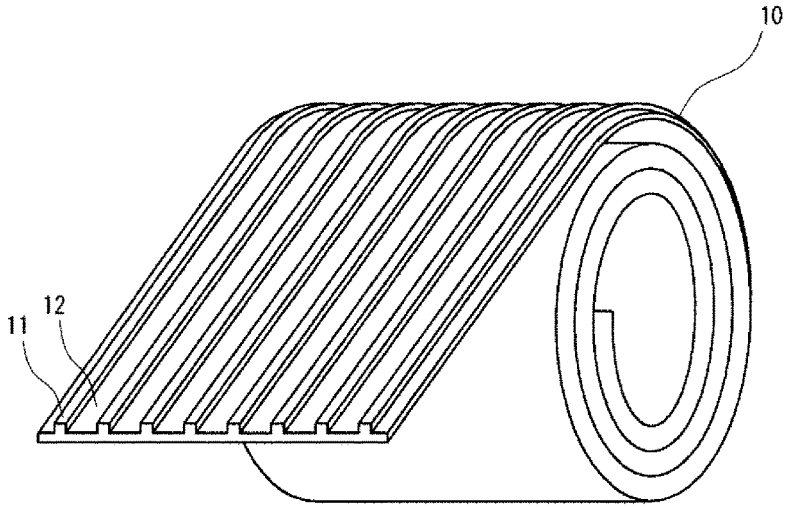
FIG. 4 is a perspective view of a metal sheet with raised lines produced by a finish-rolling mill including the roll stand illustrated in FIG. 3.
Figure 5:
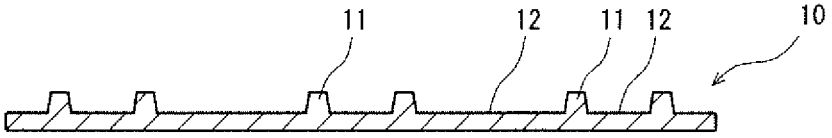
FIG. 5 is a schematic cross-sectional view of an example of the metal sheet with raised lines.
Figure 6:
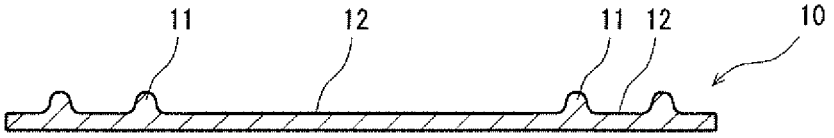
FIG. 6 is a schematic cross-sectional view of an example of the metal sheet with raised lines.
Figure 7:
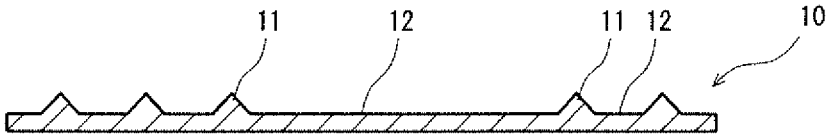
FIG. 7 is a schematic cross-sectional view of an example of the metal sheet with raised lines.
Figure 8:
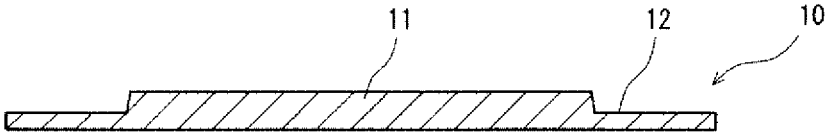
FIG. 8 is a schematic cross-sectional view of an example of the metal sheet with raised lines.

FIG. 3 is a cross-sectional view of an example of a roll stand incorporating a grooved roll according to the embodiment of the present invention. FIG. 4 is a perspective view of a metal sheet with raised lines produced by the finish-rolling mill including the roll stand illustrated in FIG. 3. In the present embodiment, as shown in FIG. 3, a grooved roll 8 is incorporated in as the upper roll 6, of the upper roll 6 and the lower roll 7 of the specified stand (the fourth stand S4 illustrated in FIG. 2). As the lower roll 7, a normal flat roll is incorporated in. In other words, the grooved roll 8 is incorporated in as one of the upper roll 6 and the lower roll 7. In the stands other than the specified stand, normal flat rolls are incorporated.

In the outer peripheral surface of the grooved roll 8, one or more grooves 9 (hereinafter, also referred to as "roll grooves") are made to extend in the circumferential direction. FIG. 3 illustrates how eight roll grooves 9 are provided at regular intervals. By the finish-rolling mill 3 including the grooved roll 8 incorporated therein, the steel plate 31 is rolled. Thereby, raised lines 11 are formed corresponding to the respective roll grooves 9, and a steel sheet 10 with raised lines 11 is produced (see FIG. 4). The raised lines 11 extend in the rolling direction of the steel sheet 10. As shown in FIGS. 3 and 4, since the grooved roll 8 is incorporated in as the upper roll 6, the raised lines 11 are formed on the upper surface of the steel sheet 10. In other words, the raised lines 11 are formed on one of the upper surface and the lower surface of the steel sheet 10.

In longitudinal sections of the grooved roll 8, each of the roll grooves 9 is rectangular, trapezoidal or V-shaped. Here, being rectangular, trapezoidal or V-shaped includes being in a shape varying a little from these shapes and in a combined shape of curved lines.

It is preferred that, in a longitudinal section of each of the grooved roll 8, the arrangement of the roll grooves 9 is bilaterally symmetric as shown in FIG. 3. Here, bilaterally means in a direction along the axial direction of the grooved roll 8 and in a width direction that is perpendicular to the rolling direction of the steel sheet 10. If the arrangement of the roll grooves 9 is bilaterally asymmetric, the rolling performed by the grooved rolls 8 will be bilaterally uneven. In this case, the steel sheet 10 is likely to move obliquely, and trouble may occur during operation. On the other hand, when the arrangement of the roll grooves 9 is bilaterally symmetric, the rolling performed by the grooved rolls 8 is bilaterally even. Then, the steel sheet 10 moves straight in the rolling direction, and any trouble due to oblique movement of the steel sheet 10 will not occur during operation.

The width w1 of the roll grooves 9 corresponds to the width of the raised lines 11 of the steel sheet 10. The pitch of the roll grooves 9 corresponds to the pitch p of the raised lines 11 of the steel sheet 10. The depth of the roll grooves 9 corresponds to the height b of the raised lines 11 of the steel sheet 10. In the steel sheet 10, the portion with the minimum sheet thickness train is formed by the rolling of the portion of the grooved roll with no roll grooves 9 (the portion hereinafter referred to as "non-grooved portion") and the flat rolls. The minimum sheet thickness tmin of the steel sheet 10 is the minimum sheet thickness of the portion with no raised lines 11. The width w2 of the non-grooved portion corresponds to the width of a recessed portion 12 between two adjacent raised lines 11 (the recessed portion hereinafter referred to as "inter-raised-line recessed portion"). The dimensions regarding the roll grooves 9 and the raised lines 11 (including the numbers and the cross-sectional shapes of these members 9 and 11) are determined basically by the designed dimensions of a structural component (pressed part) to be produced by use of the steel sheet 10 with raised lines. The determination is made in consideration of the capability of the finish-rolling mill 3, the effective length of the roll (practically 2000 mm at most) and so on. Further, the determination is made in consideration of the formability of the steel sheet 10 with raised lines into the pressed part.

For example, the width w1 of the roll grooves 9 (that is, the width of the raised lines 11) can be set to a value more than 5 mm and less than 2000 mm. In this regard, however, the width of the roll grooves 9 is desirably equal to or greater than 10 mm, and more desirably equal to or greater than 20 mm. This is to secure a sufficient width for a reinforced portion of a structural component to be produced by use of the steel sheet 10 with raised lines, thereby ensuring the strength of the structural component. Also, the width of the roll grooves 9 is desirably equal to or less than 1000 mm, and more desirably equal to or less than 500 mm. This is to reduce the weight of a structural component to be produced by use of the steel sheet 10 with raised lines.

The pitch of the roll grooves 9 (that is, the pitch p of the raised lines 11) can be set to a value more than 15 mm and less than 2000 mm. In this regard, however, the pitch of the roll grooves 9 is desirably more than 20 mm. This is to ensure the width w1 of the roll grooves 9 (that is, the width of the raised lines 11), thereby ensuring the strength of a structural component to be produced by use of the steel sheet 10 with raised lines. Also, the pitch of the roll grooves 9 is desirably equal to or less than 500 mm, and more desirably equal to or less than 200 mm. The reason is as follows. If the pitch of the roll grooves 9 is too large, in a case where the width of the roll grooves 9 (that is, the width of the raised lines 11) is small, the width w2 of the non-grooved portion (that is, the width of the inter-raised-line recessed portion 12) will be large. Then, the portion with the minimum sheet thickness tmin of the steel sheet 10 will have a large width. In this case, the portion with the minimum sheet thickness tmin will deform easily, and the quality of the steel sheet 10 will be degraded.

The sheet thickness ratio (t/tmin) of the raised line sheet thickness t (tmin h), which is the sum of the minimum sheet thickness tmin of the steel sheet 10 and the height h of the raised lines 11 (that is, the depth of the roll grooves 9), to the minimum sheet thickness tmin can be set to a value more than 1.0 and less than 10.0. In this regard, however, the sheet thickness ratio (t/tmin) is desirably equal to or more than 1.2. This is to ensure the height 11 of the raised lines 11, thereby ensuring the strength of a structural component to be produced by use of the steel sheet 10 with raised lines. Also, the sheet thickness ratio (t/tmin) is desirably less than 4.0. If the sheet thickness ratio (t/tmin) is too large, the rolling reduction achieved by the grooved roll 8 will be excessively large.

There is no particular limit to the minimum sheet thickness tmin of the steel sheet 10. However, the minimum sheet thickness tmin is practically about 0.6 to 10 mm.

FIGS. 5 to 8 are schematic cross-sectional views of other examples of a metal sheet with raised lines. Each of the steel sheets 10 illustrated in FIGS. 5 to 7 includes a plurality of raised lines 11 on its upper surface. The steel sheet 10 illustrated in FIG. 8 includes one raised line 11 on its upper surface. In any of FIGS. 5, 6 and 8, the raised lines are in a bilateral symmetric arrangement, and in FIG. 7, the raised lines are in a bilaterally asymmetric arrangement.

Here, as illustrated in FIGS. 2 and 3, when the steel plate 31 is rolled by the finish-rolling mill 3 including the grooved roll 8 incorporated as the upper roll 6 of the specified stand (the fourth stand S4 illustrated in FIG. 2), the following trouble will occur, and the process to produce a steel sheet with raised lines will not go smoothly. In the specified stand, the steel plate 31 immediately after subjected to the rolling by the rolls is more likely to stick to the grooved roll 8 as the upper roll 6 than to stick to the flat roll as the lower roll 7. This is because the steel plate 31 gets stuck in the roll grooves 9. This provides upward force to the steel plate 31 that has passed through the specified stand. Therefore, if the maximum rolling reduction achieved by the rolls of the specified stand is initially set to a required value, the leading end portion of the steel plate 31 will warp upward greatly. The greatly warping leading end portion of the steel plate 31 will wind around the grooved roll 8 or collide against the next stand without coining into the gap between the rolls of the stand.

To deal with such a trouble in operation, in the present embodiment, control described below is performed at the beginning of rolling by the finish-rolling mill 3. Until the leading edge of the steel plate 31 reaches a roll stand next to the specified stand, a maximum rolling reduction achieved by the rolls of the specified stand is set to a provisional value that is less than a required value. Then, after the leading edge of the steel plate 31 reaches the stand next to the specified stand, the maximum rolling reduction achieved by the rolls of the specified stand is changed to the required value. The setting and adjustment of the maximum rolling reduction are carried out by the inter-roll-axis distance adjustment mechanism provided for the specified stand. The maximum rolling reduction A herein is expressed by the following Formula (1).

$$A=(t0-t1)/t0\times 100[\%] \quad (1)$$

In the Formula (1), t0 denotes the sheet thickness of the steel plate 31 before subjected to the rolling in the specified stand, and t1 denotes a minimum sheet thickness of inter-raised-line recessed portions 12 in the steel sheet 10 after subjected to the rolling in the specified stand.

By performing such control, the upward force acting on the leading end portion of the steel plate 31 is reduced until the leading edge of the steel plate 31 reaches the stand next to the specified stand. Thus, warping of the leading end portion of the steel plate 31 is suppressed, and the leading edge of the steel plate 31 smoothly comes into the gap between the rolls of the next stand. Therefore, any trouble due to warping of the leading end portion of the steel plate 31 will not occur.

A timing of changing the maximum rolling reduction of the specified stand to the required value is not limited in particular, as long as the timing is after the leading edge of the steel plate 31 reaches the stand next to the specified stand. However, unless the maximum rolling reduction of the specified stand is not changed to the required value, a desired steel sheet 10 with raised lines cannot be produced. For this reason, in terms of yield, the timing of changing is preferably set at a timing immediately after the leading edge of the steel plate 31 comes into the gap between the rolls of the stand next to the specified stand.

Actually, in the present embodiment, the stand next to the specified stand is a non-rolling-performing stand for conveyance. Therefore, detection as to whether the leading edge of the steel plate 31 has reached the non-rolling-performing stand, for example, can be carried out by use of the output from the load cell provided in the specified stand, as described above. Specifically, the load cell detects the leading edge of the steel plate 31 reaching the specified stand, and an elapsed time from a time point of the detection is measured. Based on the elapsed time, a theoretical running speed of the workpiece due to rolling by the specified stand, and a distance between the roll axis of the specified stand and the roll axis of the next non-rolling-performing stand, it is possible to calculate the time point at which the leading edge of the steel plate 31 has reached the non-rolling-performing stand.

In consideration of the capability of the finish-rolling mill 3, the required value of the maximum rolling reduction of the specified stand is preferably 10 to 80%. More preferably, the required value is 20 to 60%.

To suppress the warping of the leading end portion of the steel plate 31 sufficiently, the provisional value of the maximum rolling reduction of the specified stand is preferably 10 to 90% of the required value. The provisional value is more preferably 40 to 80% of the required value.

[Production of Structural Component (Pressed Part) by Use of Metal Sheet with Raised Lines]

The above-described steel sheet 10 with raised lines is used as a blank for a structural component to be produced by press working. At the time of production of a structural component, the steel sheet 10 is cut into a shape fit for a pressed part to be used in the structural component. Before cutting, the steel sheet 10 is subjected to hot-dip galvanizing, hot-dip galvannealing, electrogalvanizing, aluminum plating or the like. Before such a plating process, the oxidized film on the surface of the steel sheet 10 is removed by pickling, shot blasting or the like. The pickling, the shot blasting, and the plating only need to be performed before the press working, and these processes may be performed toward the blank cut out from the steel sheet 10. Depending on the specification of the structural component, the plating may be omitted.

Figure 9:
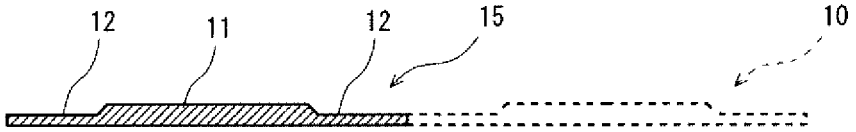
FIG. 9 is a cross-sectional view of an example of a blank cut out from a metal sheet with raised lines to be used for the production of a structural component according to an embodiment of the present invention.
Figure 10A:
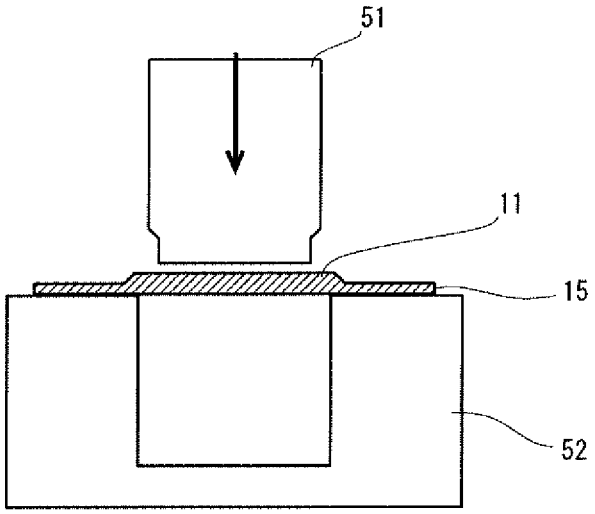
FIG. 10A is a schematic cross-sectional view of an example of an apparatus for pressing the blank illustrated in FIG. 9 into a structural component.
Figure 10B:
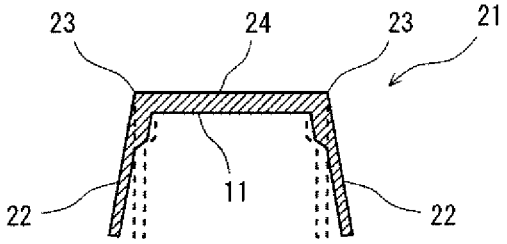
FIG. 10B is a cross-sectional view of a pressed part formed by the apparatus illustrate in FIG. 10A.
Figure 11A:
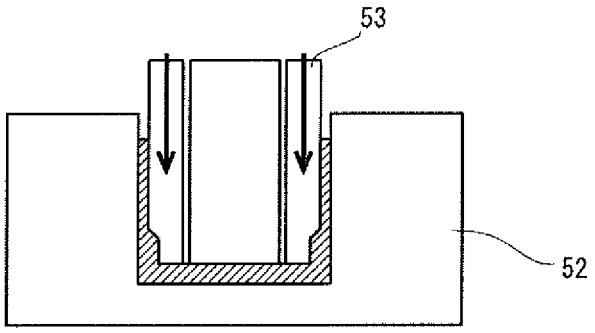
FIG. 11A is a schematic cross-sectional view of another example of an apparatus for pressing the blank illustrated in FIG. 9 into a structural component.
Figure 11B:
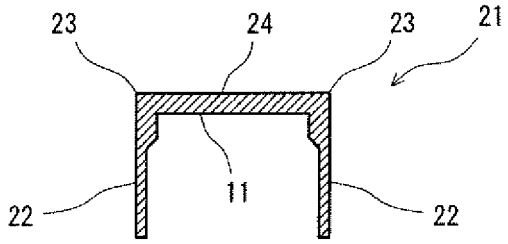
FIG. 11B is a cross-sectional view of a pressed part formed by the device illustrate in FIG. 11A.

FIG. 9 is a cross-sectional view of an example of a blank cut out from a metal sheet with raised lines to be used for the production of a structural component according to an embodiment of the present invention. FIGS. 10A and 10B are sectional views schematically showing an example of pressing to form the blank illustrated in FIG. 9 into a structural component. FIG. 10A shows a pressing machine, and FIG. 10B shows a pressed part for a structural component. FIGS. 11A and 11B show another example of pressing of the blank illustrated in FIG. 9 into a structural component. FIG. 11A shows a pressing machine, and FIG. 11B shows a pressed part for a structural component. The present embodiment describes a ease where the above-described steel sheet 10 with raised lines is used as the metal sheet with raised lines as an example.

As shown in FIG. 9, a blank 15 is cut out from the steel sheet 10. In this regard, the steel sheet 10 is cut along the longitudinal direction (the extending direction of the raised lines 11) and along the lateral direction (direction perpendicular to the extending direction of the raised lines 11). The cut position is determined depending on the specification of the structural component.

Figure 1A:
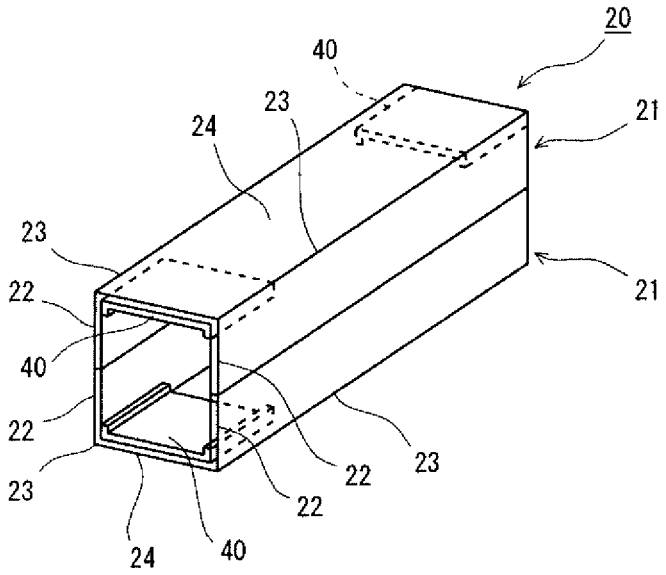
FIG. 1A is a perspective view of an example of a structural component.
Figure 1B:
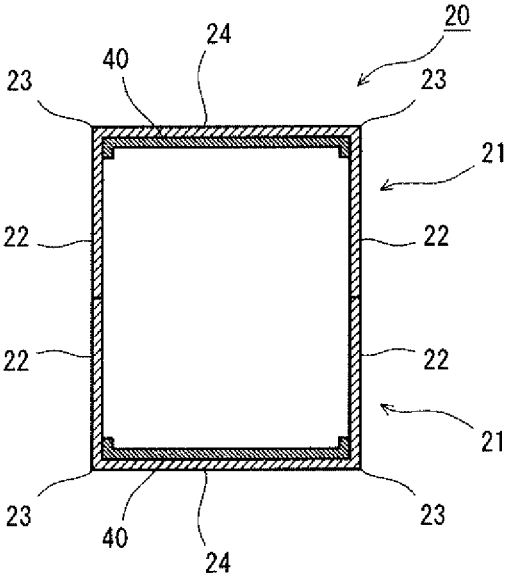
FIG. 1B is a cross-sectional view of an end portion of the structural component illustrated in FIG. 1A.

For example, the pressed part 21 shown in FIG. 10B and FIG. 11B has a U-shaped cross section. By joining two pressed parts 21, a structural component in the shape of a square pipe is produced (see FIGS. 1A and 1B). In the pressed part 21, the portion that needs to have strength is a portion from the plate portion 24 to the ridge portions 23. Therefore, when the blank 15 fit for the pressed part 21 is cut out from the steel sheet 10, the steel sheet 10 is cut at the inter-raised-line recessed portions 12 such that one of the raised lines 11 can be formed into the plate portion 24 and the ridge portions 23 of the pressed part 21.

As shown in FIG. 10A, the bank 15 can be pressed into the pressed part 21 by use of a simple set of a punch 51 and a die 52. In this case, however, as shown in FIG. 10B, since the raised line 11 with a greater sheet thickness is bent, spring-back is likely to occur. Therefore, it is preferred that a segmented punch 53 is used as illustrated in FIG. 11A. In the segmented punch 53, a shoulder portion is separated. At the time of pressing, by applying a greater load to the raised line 11 from the shoulder portion of the punch 53, it is possible to suppress the spring-back.

FIGS. 12 to 16 are schematic views showing other examples of structural components. Any of the structural components 20 (pressed parts 21) illustrated in FIGS. 12 to 16 is formed from the blank 15 cut out from the above-described steel sheet 10 with raised lines, and has one or more raised lines 11 on the front side or on the back side. These structural components formed from a steel sheet with raised lines have the following advantages over structural components formed from a steel sheet having an even sheet thickness: of having high performance as a structural component; and of being produced in a simple method. For example, no separate reinforcing member is necessary, thereby resulting in a reduction in the number of members. Integration of a reinforcing member into a structural component allows for improvements in strength and rigidity and a reduction in weight. Integration of a reinforcing member also eliminates the need to carry out a jointing process by welding, screwing and the like. Further, such a structural component including an integrated reinforcing member has a smaller overall surface area than a structural component including a separate reinforcing member, and thus, integration of a reinforcing member also results in an improvement in antirust capability.

Figure 12:
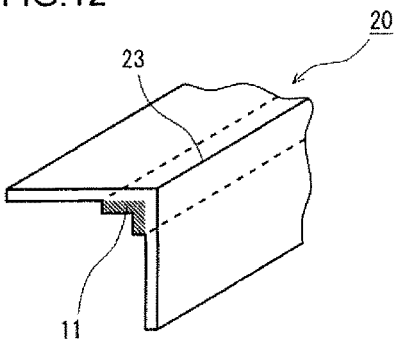
FIG. 12 is a schematic diagram of an example of a structural component.

The structural component 20 illustrated in FIG. 12 has an L-shaped cross section, and has a raised line 11 on the back side of the ridge portion 23. In this case, the ridge portion 23 is reinforced throughout the whole length, and the strength of the structural component 20 is improved.

Figure 13:
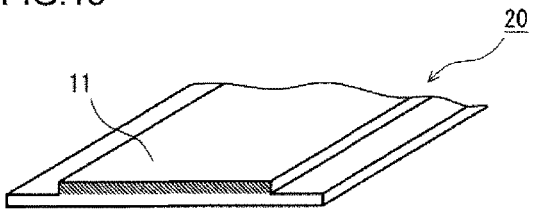
FIG. 13 is a schematic diagram of an example of a structural component.

The structural component 20 illustrated in FIG. 13 is substantially planar, and has a wide raised line 11 on the front side, in the center. In this case, the central portion is reinforced over a wide range throughout the whole length, and the strength of the structural component 20 is improved.

Figure 14:
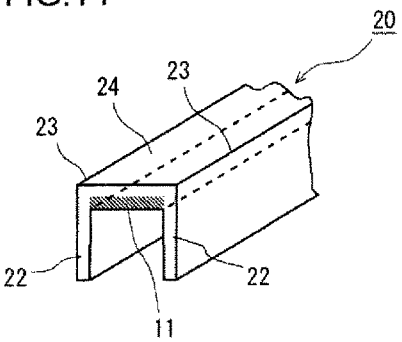
FIG. 14 is a schematic diagram of an example of a structural component.
Figure 15:
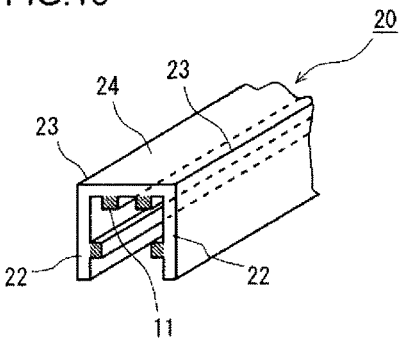
FIG. 15 is a schematic diagram of an example of a structural component.

The structural component 20 illustrated in FIG. 14 has a U-shaped cross section, and has a raised line 11 on the back side of the ridge portions 23 and the plate portion 24. In this case, the plate portion 24 and the ridge portions 23 are reinforced throughout the whole length, and the strength of the structural component 20 is improved. Further, by locating the raised line 11 at a distance from the axis of bending (neutral axis), it is possible to minimize an increase in weight, thereby resulting in a great enhancement of the second moment of area.

The structural component 20 illustrated in FIG. 17 has a U-shaped cross section, and has raised lines 11 on the back side of the portions near the ridge portions 23. In this case, the portions of the plate portion 24 near the ridge portions 23 and the portions of the flanges 22 near the ridge portions 23 are reinforced throughout the whole length, and the strength of the structural component 20 is improved. With regard to the structural component 20 shown in FIG. 16, not the raised lines 11 but the portions near the raised lines 11 is bent at the time of press working, and the formability is good. Specifically, the steel sheet with raised lines has in-plane anisotropy because of the presence of raised lines. Utilization of this characteristic allows for both a reduction in the pressing load at the time of press working and enhancements of the pressed part in strength and rigidity.

Figure 16:
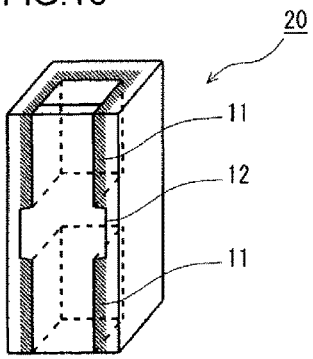
FIG. 16 is a schematic diagram of an example of a structural component.

The structural component 20 illustrated in FIG. 16 is shaped like a square pipe. This structural component 20 is a combination of a pressed part having a U-shaped cross section and a metal sheet. In the square-pipe-like structural component 20, the raised lines 11 are arranged to extend in the circumferential direction. Accordingly, the inter-raised-line recessed portion 12 extends in the circumferential direction of the square-pipe-like structural component 20. In this case, the portions where the raised lines 11 are located are reinforced throughout the whole circumference, and the strength of the structural component 20 is improved. Therefore, even if another component is welded to any of the portions where the raised lines 11 are located, the structural component 20 maintains strength. Accordingly, the structural component 20 is effectively used as a component required to be welded to another component. The structural component 20 is effectively used especially as a welded component of which thickening is restricted for the reason of constraints on weight and space. With regard to the structural component 20 illustrated in FIG. 16, the portion where the inter-raised-line recessed portion 12 is located is fragile throughout the whole circumference. Accordingly, the portion where the inter-raised-line recessed portion 12 is located is more breakable than the portions where the raised lines 11 are located. Therefore, the structural component 20 is effectively used as a component of which breakdown region is intentionally specified.

In the above-described embodiment, the steel sheet 10 with raised lines is produced by hot working by use of the finish-rolling mill 3. Therefore, in the thick portions where the raised lines 11 are located, the cooling rate is slow, and the hardness is likely to become low, as compared with those in the other portions (the inter-raised-line recessed portions 12). Utilizing this characteristic of the raised lines 11, it is possible to improve the formability by using the portions where the raised lines 11 are located as the portions of a structural component to be shaped with difficulty.

TABLE 1 below shows examples of a strength difference between a portion where a raised line is located and another portion. As is clear from TABLE 1, the strength difference varies depending on the material of the workpiece (whether high-carbon steel or low-carbon steel), the difference between the raised-line sheet thickness and the minimum sheet thickness, the cooling rate and the like. The portion where the raised line is located always has higher hardness than any other portion.

TABLE 1

| Test No. | Material | Raised-line sheet thickness [mm] | Minimum sheet thickness [mm] | Cooling rate [° C./sec] | Steel sheet running speed [m/min] | Strength difference [MPa] |
|---|---|---|---|---|---|---|
| A | High-carbon steel | 3.0 | 1.0 | 50 | 300 | 300 |
| B | Low-carbon steel | 3.0 | 1.0 | 20 | 300 | 100 |
| C | High-carbon steel | 3.0 | 2.0 | 50 | 300 | 250 |
| D | Low-carbon steel | 3.0 | 2.0 | 20 | 300 | 50 |
| E | High-carbon steel | 4.0 | 1.0 | 50 | 300 | 400 |
| F | Low-carbon steel | 4.0 | 1.0 | 20 | 300 | 200 |

As thus far described, the metal sheet production method according to the present embodiment facilitates the production of a metal sheet with raised lines. The metal sheet with raised lines has, one of the upper surface and the lower surface, one or more raised lines extending in the rolling direction. Accordingly, when the metal sheet is used as a material for a partly-reinforced structural component, it is possible to obtain a structural component including a reinforced portion that is reinforced in the entire area. Thus, the metal sheet with raised lines is suited to be used as a material for a partly-reinforced structural component. The use of the metal sheet with raised lines eliminates the need to weld a separate reinforcing plate to partly reinforce the structural component. This allows for a reduction in manufacturing cost.

The present invention is not limited to the above-described embodiment, and various changes are possible without departing from the gist and scope of the present invention. For example, the grooved roll may be incorporated in as the lower roll of the specified stand. In addition, the metal sheet with raised lines, the material of the metal sheet, the material of the structural component formed from the metal sheet are not limited to steel, such as ordinary carbon steel, high-tensile steel, stainless steel and the like, and aluminum, copper and the like may be used.

In the rolling mill including grooved roll, the total number of stands is not limited. However, since the grooved roll is incorporated in a stand at least one stage before the last stand, the total number of stands is at least two.

The method for pressing a blank cut out from the metal sheet with raised lines into a structural component is not particularly limited. As the method, for example, it is possible to adopt a hot stamping method in which forming and quenching are carried out in a mold.

REFERENCE SIGNS LIST

1: heating furnace
2: rough-rolling mill
3: finish-rolling mil
4: cooling device
5: coiler
S1 to S6: roll stand
6: upper roll
7: lower roll
8: grooved roll
9: groove
10: steel sheet
11: raised line
12: inter-raised-line recessed portion
15: blank
20: structural component
21: pressed part
22: flange
23: ridge portion
24: plate portion
30: slab
31: steel sheet
51: punch
52: die
53: segmented punch
w1: width of roll groove
w2: width of non-grooved region
p: pitch of raised line
train: minimum sheet thickness
h: height of raised lines
t: raised-line sheet thickness

The invention claimed is:

1. A method for producing a metal sheet by use of a rolling mill including at least two roll stands, the metal sheet including, on an upper surface or a lower surface, one or more raised lines extending in a rolling direction, the method comprising:

a preparing step of preparing a grooved roll, the grooved roll including, in an outer peripheral surface, one or more grooves extending in a circumferential direction;

a choosing step of choosing a roll stand at least one stage before a last roll stand, from the roll stands;

an incorporating step of incorporating the grooved roll in the rolling mill as an upper roll or a lower roll of the chosen, specified roll stand; and a forming step of rolling a workpiece by the rolling mill incorporating the grooved roll, thereby forming the workpiece into a metal sheet with raised lines formed corresponding to the respective grooves of the grooved roll, wherein in the forming step, until a leading edge of the workpiece reaches a roll stand next to the specified roll stand, a maximum rolling reduction achieved by rolls of the specified roll stand is set to a provisional value that is less than a required value, and after the leading edge of the workpiece reaches the roll stand next to the specified roll stand, the maximum rolling reduction achieved by the rolls of the specified roll stand is changed to the required value;

the roll stand next to the specified roll stand being a non-rolling performing roll stand for conveyance.

2. The method for producing a metal sheet with raised lines according to claim 1, wherein the required value is 10 to 80%.

3. The method for producing a metal sheet with raised lines according to claim 1, wherein the provisional value is 10 to 90% of the required value.

4. The method for producing a metal sheet with raised lines according to claim 1, wherein in a longitudinal section of the grooved roll, the grooves are in a bilaterally symmetric arrangement.

5. The method for producing a metal sheet with raised lines according to claim 1, wherein in a longitudinal section of the grooved roll, the grooves is rectangular, trapezoidal or V-shaped.

6. The method for producing a metal sheet with raised lines according to claim 1, wherein each of the grooves in the grooved roll has a width more than 5 mm and less than 2000 mm.

7. The method for producing a metal sheet with raised lines according to claim 1, wherein the grooves of the grooved roll are at a pitch more than 15 mm and less than 2000 mm.

* * * * *